US005491379A

United States Patent [19]

Daigle et al.

[11] Patent Number: 5,491,379

[45] Date of Patent: Feb. 13, 1996

[54] ELECTROLUMINESCENT EDGE CONNECT-COMPOSITE LAMP/STRIP AND METHOD OF MAKING THE SAME

[75] Inventors: Lyman R. Daigle, Bethlehem; Andrew C. Ledesma, Woodbury, both of Conn.; Sotero A. Ang, Mandaue City, Philippines

[73] Assignee: Timex Corporation, Middlebury, Conn.

[21] Appl. No.: 320,813

[22] Filed: Oct. 11, 1994

[51] Int. Cl.[6] ..... H01D 63/04; B05D 5/12

[52] U.S. Cl. ..... 313/509; 313/506; 313/507; 427/108; 427/261; 427/269; 427/404; 427/66; 427/125

[58] Field of Search ..... 427/66, 108, 125, 427/261, 269, 404, 419.2; 315/169.2; 313/506, 507, 509

[56] References Cited

U.S. PATENT DOCUMENTS 4,238,793 12/1980 Hochstrate ..... 340/781
4,534,743 8/1985 D'Onofrio et al. ..... 445/24
4,775,964 10/1988 Alessio et al. ..... 368/67
5,194,777 3/1993 Nakaya et al. ..... 427/66
5,265,071 11/1993 Thorgersen et al. ..... 368/67
5,346,718 9/1994 Thorgersen et al. ..... 427/66

*Primary Examiner*—Janyce Bell
*Attorney, Agent, or Firm*—William C. Crutcher; David H. Hwang

[57] ABSTRACT

The method and structure for providing a pair of electrical contact terminals on the back side of an electroluminescent (EL) lamp. The EL lamp has a first conductive layer, a layer of EL material, a first insulating layer, a second conductive layer, a second insulating layer and a film of conductive material, all disposed on a transparent substrate, respectively. The film of conductive material extends around the second insulating layer to come in electrical contact with the first conductive layer. This allows an electrical contact terminal to be established on the film of conductive material, rather than directly on the first conductive layer. The other electrical contact terminal is positioned on the second conductive layer. The second insulating layer serves to electrically separate the two contact terminals.

11 Claims, 2 Drawing Sheets

ELECTROLUMINESCENT EDGE CONNECT-COMPOSITE LAMP/STRIP AND METHOD OF MAKING THE SAME

BACKGROUND OF THE INVENTION

This invention relates generally to electroluminescent lamps and more particularly to an improved method and structure for making electrical connections to an electroluminescent lamp from only one side of the lamp.

Electroluminescent lamps are generally constructed as laminated or layered structures. Electroluminescent lamps function by application of an electrical potential to two conductive layers separated by an electroluminescent layer, which may comprise electroluminescent particles fixed in a resin binder.

Electroluminescent lamps have been modified to provide a lighted watch dial, as disclosed in U.S. Pat. No. 4,775,964 issued Oct. 4, 1988 to Alessio et al and assigned to the present assignee. While it is easy to make one of the electrical contacts to the back electrode comprising a conductive area on the underside of the electroluminescent watch dial, it is more difficult to make the other electrical contact to the front electrode, since this is a conductive layer which is embedded between other layers. Therefore, it has been necessary to either omit a part of the electroluminescent material to expose the front electrode, as shown in the aforesaid Alessio et al patent, or to provide a special overlap area extending beyond the normal periphery of the lamp.

An improved electroluminescent watch dial support and connector assembly is shown in U.S. Pat. No. 5,265,071 issued Nov. 23, 1993 and assigned to the present assignee, employing special tabs extending beyond the dial periphery for making electrical contact. However, it would be desirable to make electrical contact to both of the electroluminescent electrodes from any location on the back of the EL lamp without regard to the location of the lamp periphery.

It should be recognized that wherever electroluminescent material is missing, there is an objectionable dark spot on the lamp, since there are no electroluminescent particles to luminesce. In the case of an electroluminescent watch dial, it is preferable that the entire area used for observing the timekeeping numbers or other indicia be lighted without the presence of such a dark spot. However, there are some areas near the center of the watch dial in which a dark spot may be permitted without interfering noticeably with the aesthetic qualities of the timepiece. In U.S. Pat. No. 5,346,718 issued Sep. 13, 1994 and assigned to the present assignee, a process of manufacturing an electroluminescent watch dial is disclosed in which the dark spot could be located wherever desired, and which also permits electrical connection to both front and back electrodes from any location on the rear of the electroluminescent watch dial. Nonetheless, it would be desirable to make electrical contact to both of the electroluminescent electrodes from any location on the back of the EL lamp with the dark spot minimized to virtual nonexistence.

Accordingly, it is the object of the present invention to provide an improved electroluminescent lamp and method of making the same in which electrical contacts are permitted from any location on one side of the lamp with the dark spot minimized to near elimination.

SUMMARY OF THE INVENTION

Briefly stated, the invention in its broadest form is practiced by providing a transparent substrate with a first conductive layer thereon, the first conductive layer terminating in a first edge, depositing an electroluminescent layer on the first conductive layer, depositing a first insulating layer on the electroluminescent layer, depositing a second conductive layer on the first insulating layer, the second conductive layer having a second edge spaced from the first edge, depositing a second insulating layer on the second conductive layer, the second insulating layer having an insulating end extending around and enclosing the second edge of the second conductive layer, and depositing a film of conductive material on the second insulating layer, a conductive end of the film extending around the insulating end and making electrical contact with the first conductive layer.

BRIEF DESCRIPTION OF THE DRAWINGS

The invention, both as to organization and to method of practice, together with further objects and advantages thereof, will best be understood by reference to the following specification, taken in connection with the accompanying drawings, in which.

DETAILED DESCRIPTION OF THE PREFERRED EMBODIMENT

Figure 1:
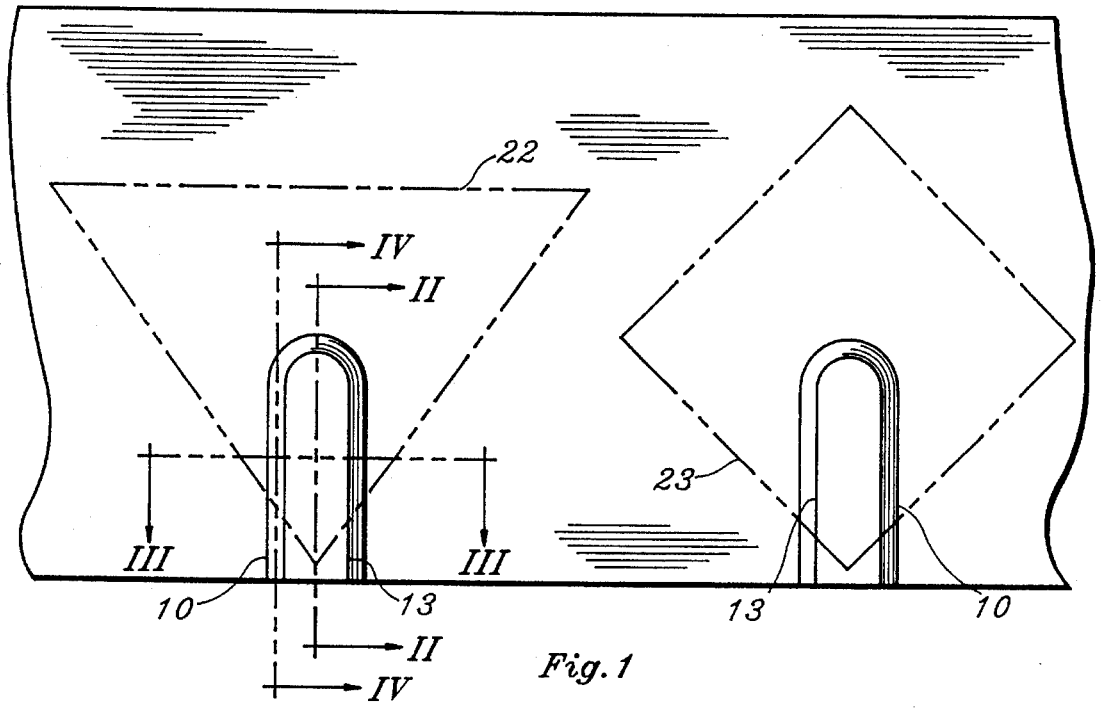
FIG. 1 is a top view with respect to the front electrode terminals of an electroluminescent lamp strip showing the outlines of a triangular and rhomboid dial cutouts.

FIG. 1 illustrates a segment of an electroluminescent lamp strip 30 having two dial cutouts. The view is with respect to the front electrode terminals 13 on top. As will become apparent hereinafter, the front electrode terminal 13 lies opposite the side where the time indicating display (e.g., hands of a watch) would lie. Although outlines of a triangular 22 and rhomboid 23 dial cutouts are shown, the dial cutout may be any shape desired.

Figure 2:
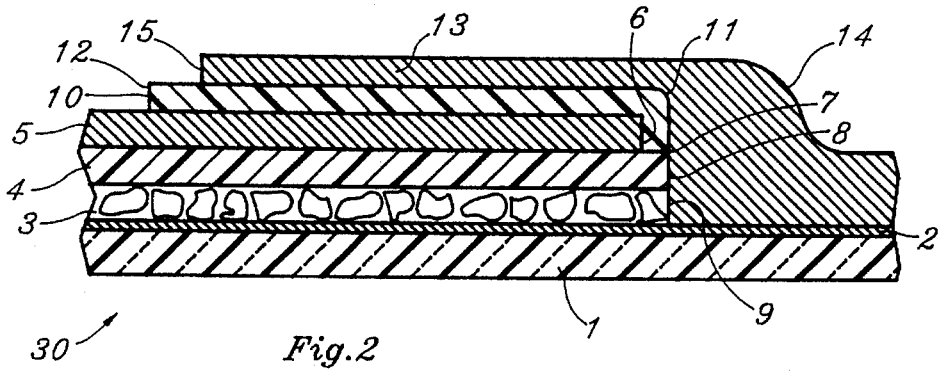
FIG. 2 is an enlarged side elevational view in cross section of the electroluminescent lamp strip where the cross section is along lines II—II of FIG. 1.

Referring now to FIG. 2 of the drawings, the electroluminescent lamp strip 30 is shown in cross section along lines II—II of FIG. 1. The drawing is not to scale, and the layers are greatly enlarged for purposes of illustration, it being understood that some of the layers referred to herein are quite thin. As a general rule, the electroluminescent lamp thickness is only on the order of 0.15 to 0.20 mm. It may be cut and imprinted to form an analog watch dial which is flexible and requires a support, as set forth in the aforesaid U.S. Pat. No. 5,265,071. The process described herein, however, applies to an electroluminescent lamp for any type of device, including LCD backlights for any kind of instrument.

The EL lamp strip 30 comprises a transparent substrate 1 having deposited thereon a first conductive layer 2. Commercially, the substrate 1 with the conductive layer 2 already on it is commercially available in the form of Mylar™ (a registered trademark of E. I. duPont de Nemours & Co.) having an indium tin oxide (ITO) coating. On the first conductive layer 2, which may also be referred to as the front electrode, an electroluminescent layer 3 is deposited. The electroluminescent layer 3, as is well known in the art, comprises electroluminescent particles such as ZnS:Cu which are thoroughly mixed in a polymerizable resin. The EL mixture is silk screened or otherwise uniformly coated on the first conductive layer 2.

Next, a first insulating layer 4 is applied over the electroluminescent layer 3. This is done by silk screening or another suitable process. The first insulating layer 4 may be composed of barium titanate or other appropriate dielectrics. A second conductive layer 5 is then silk screened or otherwise uniformly deposited on the first insulating layer 4. An edge 6 of the second conductive layer 5 is preferably setback from a line 7 formed by edges 8, 9 of the first insulating layer 4 and the electroluminescent layer 3. The reason for this will become apparent hereinafter. The second conductive layer 5, which may also be referred to as the back electrode, may be composed of silver or any other suitable electrically conductive material.

Over the back electrode 5, a second insulating layer 10 is silk screened or otherwise uniformly applied. As was the case for the first insulating layer 4, the second insulating layer 10 may be comprised of barium titanate or other appropriate dielectrics. The second insulating layer 10 has an insulating end 11 which extends around and encloses the edge 6 of the back electrode 5. Furthermore, as shown in FIG. 2, a second end 12 of the second insulating layer 10 does not extend the width of the electroluminescent lamp strip 30.

Finally, a film of conductive material 13 is applied onto the second insulating layer 10 by silk screening or other suitable process. The film 13 may be composed of silver or any other appropriate electrically conductive material. A conductive end 14 of the film 13 extends around the insulating end 11 of the second insulating layer 10 and electrically contacts the front electrode 2. This permits an electrical contact area to be established on the film 13, thereby circumventing the need to position an electrical contact area directly on the front electrode 2. A second end 15 of the film 13, as illustrated in FIG. 2, is setback from the second end 12 of the second insulating layer 10. Electrical separation of the back electrode 5 and the film of conductive material 13, which may also be referred to as the front electrode terminal, is thus maintained since the possibility of the front electrode terminal 13 extending over the second end 12 of the second insulating layer 10 is prevented.

Figure 3:
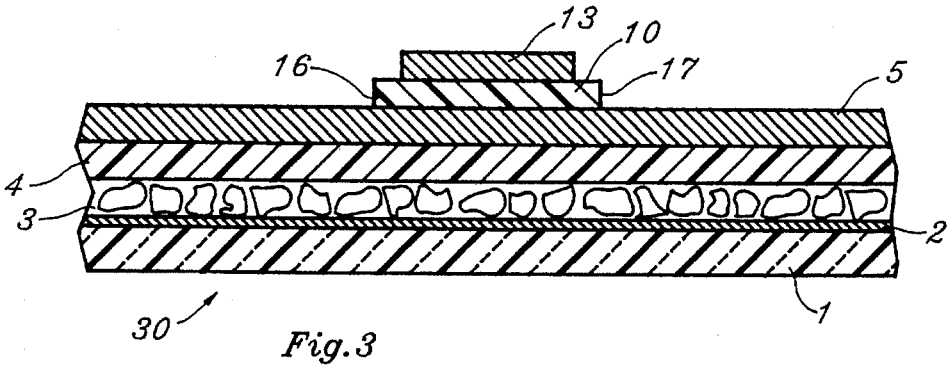
FIG. 3 is an enlarged side elevational view in cross section of the electroluminescent lamp strip where the cross section is along lines III—III of FIG. 1.

FIG. 3 represents a cross section of the electroluminescent lamp strip 30 along lines III—III of FIG. 1. As shown in the drawing, the width of the second insulating layer 10 is narrower than the widths of the layers beneath it. The width of the front electrode terminal 13 is even narrower than the width of the second insulating layer 10. This ensures a noncontacting relationship between the front electrode terminal 13 and the back electrode 5 by precluding the possibility of the front electrode terminal 13 extending over the sides 16, 17 of the second insulating layer 10.

Figure 4:
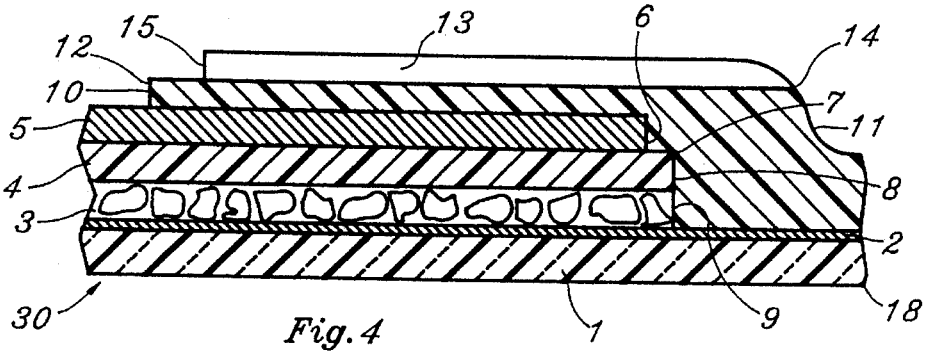
FIG. 4 is an enlarged side elevational view in cross section of the electroluminescent lamp strip where the cross section is along lines IV—IV of FIG. 1.

A cross section of the electroluminescent lamp strip 30 along lines IV—IV of FIG. 1 is illustrated in FIG. 4. This is similar to FIG. 2 in all respects except for the insulating end 11 of the second insulating layer 10 extending to a first edge 18 of the electroluminescent lamp strip 30. By extending to the first edge 18, not only does the insulating end 11 enclose the edge 6 of the back electrode 5, but the insulating end 11 also contains the conductive end 14 of the front electrode terminal 13 so as to facilitate the electrical contact between the conductive end 14 and the front electrode 2 as shown in FIG. 2.

Figure 5:
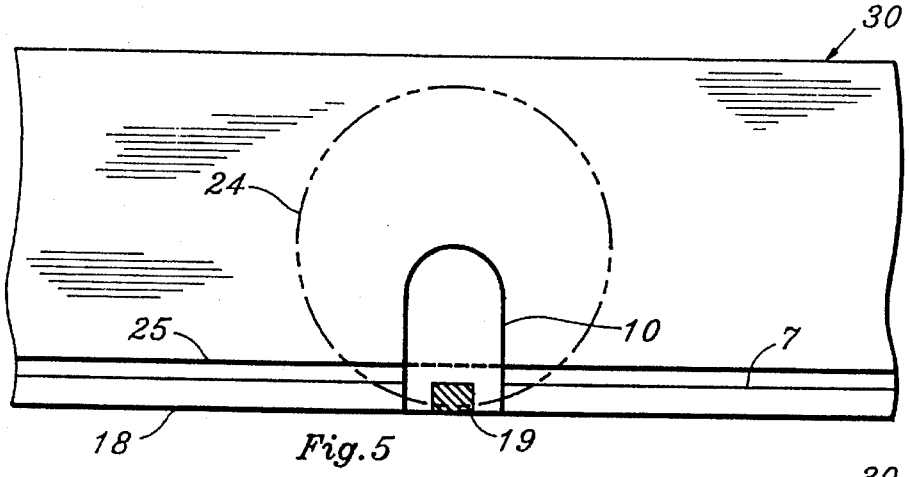
FIG. 5 is a top view with respect to the second insulating layer of an electroluminescent lamp strip with the front electrode terminal omitted, showing an electrical contact area of the front electrode terminal.

In FIG. 5, a view of the electroluminescent lamp strip 30 with the second insulating layer 10 on top is shown. A circular dial cutout 24 is outlined as illustrated. The front electrode terminal 13 is omitted from the drawing for purposes of clarity. Note that a shaded region 19 behind the line 7 formed by the edges 8, 9 of the first insulating layer 4 and the electroluminescent layer 3 represents the area where the conductive end 14 of the front electrode terminal 13 is in electrical contact with the front electrode 2. Therefore, as long as the dial cutout includes some portion of the shaded region 19, the object of the present invention may be realized. Although the shaded region 19 depicted in FIG. 5 is rectangular, it can be any shape or size desired. For instance, it can be the size of a pinhole.

Figure 6:
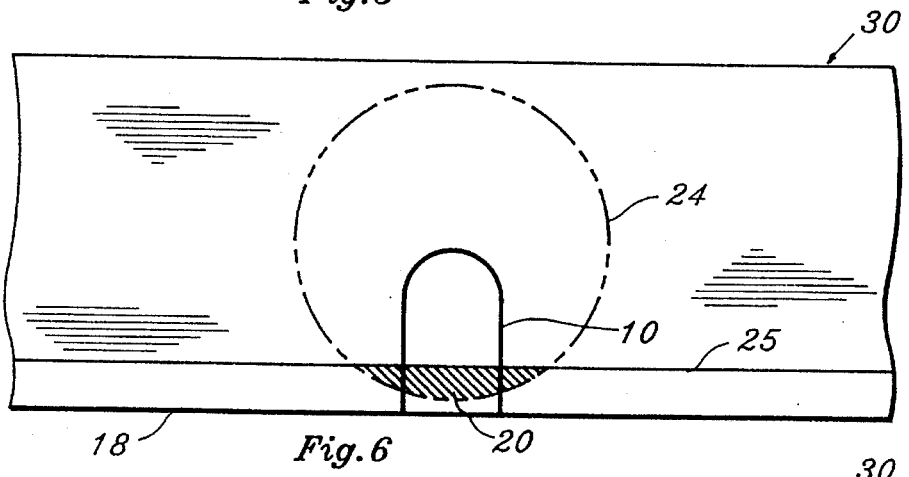
FIG. 6 is similar to FIG. 5, except the darkened region represents an area of the dial cutout where a dark spot is present.

FIG. 6 is the same view as that shown in FIG. 5, except for a darkened region 20 behind a line 25 formed by the edge 6 of the second conductive layer 5. In the preferred embodiment, this darkened region 20 represents the area of the dial cutout where there is a dark spot. However, because the darkened region 20 is on the edge of the dial cutout, its presence has little effect on the luminescence of the watch dial. Furthermore, by including a minimal portion of the darkened region 20 in the dial cutout, the size of the dark spot present on the dial can thus be minimized. And the problems associated with the presence of a dark spot on the dial can be virtually eliminated.

Figure 7:
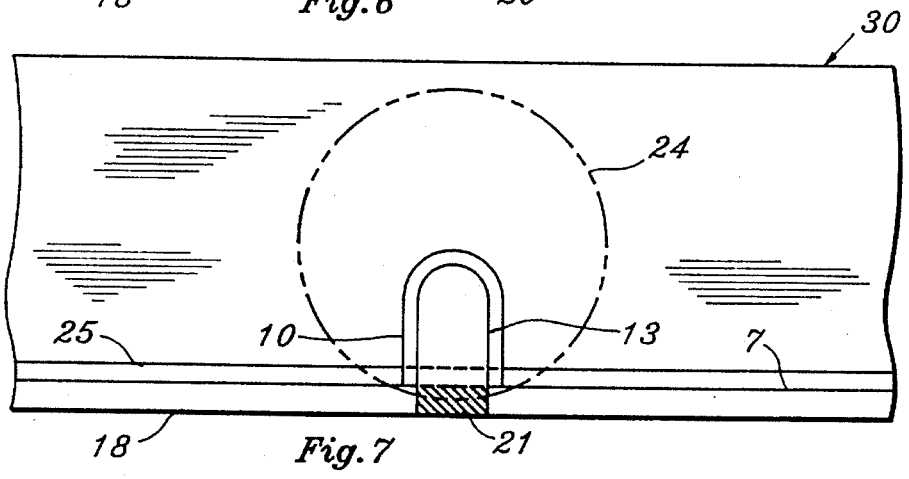
FIG. 7 is a top view with respect to the front electrode terminal of a modified electroluminescent lamp strip showing the position of a circular dial cutout.

In another embodiment, shown in FIG. 7, the insulating end 11 of the second insulating layer 10 is not extended to the first edge 18 of the electroluminescent lamp strip 30 as done in FIG. 4. Rather, the insulating end 11 terminates at the line 7 formed by the edges 8, 9 of the first insulating layer 4 and the electroluminescent layer 3. Therefore, as this view of the electroluminescent lamp strip 30 with the front electrode terminal 13 on top illustrates, the conductive end 14 of the front electrode terminal 13 which is in electrical contact with the front electrode 2 is represented by a hatched region 21. As described above, the dial cutout need only include a portion of the hatched region 21 for the object of the present invention to be realized. This is shown by the outline of the circular dial cutout 24.

One electrical contact terminal may be located at any desired position on the front electrode terminal 13 included in the dial cutout. The other electrical contact terminal may be located at any desired position on the back electrode 5 not covered by the second insulating layer 10. In this manner, the two terminals may be located on the back of the EL lamp without regard to other design constraints.

While there has been described what has been considered the preferred embodiment of the invention and a modification thereof, other modifications of the present invention will occur to those skilled in the art, and it is desired to secure in the appended claims all such modifications as fall within the true spirit and scope of the invention.

We claim:

1. A process for providing a pair of electrical contact areas on one side of an electroluminescent lamp, comprising the steps of:

providing a transparent substrate having a first conductive layer thereon, the first conductive layer having an edge;

depositing an electroluminescent layer on the first conductive layer, the electroluminescent layer having an edge spaced from the edge of the first conductive layer;

depositing a first insulating layer on the electroluminescent layer, the first insulating layer having an edge spaced from the edge of the first conductive layer;

depositing a second conductive layer on the first insulating layer, the second conductive layer having an edge spaced from the edge of the first conductive layer;

depositing a second insulating layer on the second conductive layer, the second insulating layer having an insulating end extending around and enclosing the edge of the second conductive layer; and depositing a film of conductive material on the second insulating layer, the film having a conductive end extending around the insulating end and making electrical contact with the first conductive layer.

2. The process according to claim 1, wherein the step of depositing the first insulating layer on the electroluminescent layer includes having the edge of the first insulating layer in substantial alignment with the edge of the electroluminescent layer.

3. The process according to claim 2, wherein the step of depositing the second conductive layer on the first insulating layer includes having the edge of the second conductive layer spaced from the edge of the first insulating layer.

4. The process according to claim 3, wherein the step of depositing the second insulating layer on the second conductive layer includes having the insulating end in substantial alignment with the edges of the first insulating layer and the electroluminescent layer.

5. A process for providing a pair of electrical contact areas on one side of an electroluminescent lamp, comprising the steps of:

providing a transparent substrate having a first conductive layer thereon, the first conductive layer having a first edge and a second edge;

depositing an electroluminescent layer on the first conductive layer, the electroluminescent layer having an edge Spaced from the first edge;

depositing a first insulating layer on the electroluminescent layer, the first insulating layer having an edge spaced from the first edge;

depositing a second conductive layer on the first insulating layer, the second conductive layer having an edge spaced from the first edge;

depositing a second insulating layer on the second conductive layer, the second insulating layer having an insulating end extending around and enclosing the edge of the second conductive layer and a second end spaced from the second edge; and depositing a film of conductive material on the second insulating layer, the film having a conductive end extending around the insulating end and making electrical contact with the first conductive layer and a second end spaced from the second edge.

6. The process according to claim 5, wherein the step of depositing the first insulating layer on the electroluminescent layer includes having the edge of the first insulating layer in substantial alignment with the edge of the electroluminescent layer.

7. The process according to claim 6, wherein the step of depositing the second conductive layer on the first insulating layer includes having the edge of the second conductive layer spaced from the edge of the first insulating layer.

8. The process according to claim 7, wherein the step of depositing the second insulating layer on the second conductive layer includes having the insulating end in substantial alignment with the edges of the first insulating layer and the electroluminescent layer.

9. The process according to claim 5, wherein the step of depositing the film of conductive material on the second insulating layer includes having the second end of the film spaced from the second end of the second insulating layer.

10. An electroluminescent lamp for a timepiece, which comprises:

a transparent substrate having a first conductive layer thereon, the first conductive layer having an edge;

an electroluminescent layer on the first conductive layer, the electroluminescent layer having an edge spaced from the edge of the first conductive layer;

a first insulating layer on the electroluminescent layer, the first insulating layer having an edge spaced from the edge of the first conductive layer;

a second conductive layer on the first insulating layer, the second conductive layer having an edge spaced from the edge of the first conductive layer;

a second insulating layer on the second conductive layer, the second insulating layer having an insulating end extending around and enclosing the edge of the second conductive layer; and a film of conductive material on the second insulating layer, the film having a conductive end extending around the insulating end and making electrical contact with the first conductive layer.

11. An electroluminescent lamp for a timepiece, which comprises:

a transparent substrate having a first conductive layer thereon, the first conductive layer having a first edge and a second edge;

an electroluminescent layer on the first conductive layer, the electroluminescent layer having an edge spaced from the first edge;

a first insulating layer on the electroluminescent layer, the first insulating layer having an edge spaced from the first edge;

a second conductive layer on the first insulating layer, the second conductive layer having an edge spaced from the first edge;

a second insulating layer on the second conductive layer, the second insulating layer having an insulating end extending around and enclosing the edge of the second conductive layer and a second end spaced from the second edge; and a film of conductive material on the second insulating layer, the film having a conductive end extending around the insulating end and making electrical contact with the first conductive layer and a second end spaced from the second edge.

* * * * *